US008408308B2

(12) United States Patent
Al Busaidy

(10) Patent No.: US 8,408,308 B2
(45) Date of Patent: Apr. 2, 2013

(54) APPARATUS AND METHOD FOR INCREASING THE AMOUNT OF DYNAMIC UNDERBALANCE IN A WELLBORE

(75) Inventor: Adil Mahallab Al Busaidy, Seeb (OM)

(73) Assignee: Schlumberger Technology Corporation, Sugar Land, TX (US)

( * ) Notice: Subject to any disclaimer, the term of this patent is extended or adjusted under 35 U.S.C. 154(b) by 393 days.

(21) Appl. No.: 12/792,209

(22) Filed: Jun. 2, 2010

(65) Prior Publication Data

US 2010/0300690 A1 Dec. 2, 2010

Related U.S. Application Data

(60) Provisional application No. 61/183,122, filed on Jun. 2, 2009.

(51) Int. Cl.
*E21B 37/00* (2006.01)

(52) U.S. Cl. ..... 166/311; 166/376; 166/63

(58) Field of Classification Search ..... 89/1.15, 89/1.151; 102/301, 313, 314, 320, 321, 321.1, 102/323, 331; 72/370.2, 370.21, 379.6; 166/298, 166/299, 376, 63, 55; 175/4.6
See application file for complete search history.

(56) References Cited

U.S. PATENT DOCUMENTS

| | | | | | |
|---|---|---|---|---|---|
| 337,492 | A * | 3/1886 | Hadesty | 86/21 |
| 2,530,833 | A * | 11/1950 | Martin | 175/4.56 |
| 3,029,981 | A | 4/1962 | Webster | |
| 3,215,074 | A | 11/1965 | Robinson | |
| 3,289,583 | A * | 12/1966 | Silverman | 181/116 |
| 3,349,705 | A * | 10/1967 | Wilson | 102/314 |
| 4,090,447 | A * | 5/1978 | Johnsen | 102/313 |
| 4,974,671 | A * | 12/1990 | Omnes | 166/55.1 |
| 4,982,662 | A | 1/1991 | Beck | |
| 5,997,232 | A | 12/1999 | Sauer | |
| 6,557,636 | B2 * | 5/2003 | Cernocky et al. | 166/297 |
| 6,702,039 | B2 * | 3/2004 | Parrott et al. | 175/4.6 |
| 6,732,798 | B2 | 5/2004 | Johnson | |
| 7,182,138 | B2 | 2/2007 | Behrmann | |
| 2003/0029639 | A1 * | 2/2003 | Parrott et al. | 175/4.6 |
| 2012/0090491 | A1 * | 4/2012 | Young | 102/314 |

* cited by examiner

*Primary Examiner* — Kenneth L Thompson

(57) ABSTRACT

A method for use in a wellbore includes the steps of providing an elongated, closed tubular body defining an internal chamber wherein the tubular body has an external surface formed with treated areas and an elongated recess extending longitudinally of the tubular body and running through the treated areas; retaining a detonating device in the recess adjacent the external surface of the tubular body; positioning the tubular body with the detonating device in a wellbore adjacent perforation tunnels previously formed in a surrounding well formation and filled with debris; and activating the detonating device to rupture the tubular body inwardly along the external surface forming the recess at the treated areas to expose the chamber within the tubular body to a dynamic underbalanced pressure condition such that fluid from the wellbore and debris from the perforation tunnels is drawn through the wellbore and into the chamber.

24 Claims, 4 Drawing Sheets

APPARATUS AND METHOD FOR INCREASING THE AMOUNT OF DYNAMIC UNDERBALANCE IN A WELLBORE

FIELD

The present disclosure relates to improving communication of formation fluids within a wellbore using dynamic underbalance to effectively clean perforation tunnels previously formed in the surrounding formation of a well.

BACKGROUND

To complete a well, one or more formation zones adjacent a wellbore are perforated to allow fluid from the formation zones to flow into the well for production to the surface or to allow injection fluids to be applied into the formation zones. A perforating gun string may be lowered into the well and the guns fired to create openings in a casing and to extend perforation tunnels into the surrounding formation.

The explosive nature of the formation of perforation tunnels shatters sand grains of the formation. A layer of "shock damaged region" having a permeability lower than that of the virgin formation matrix may be formed around each perforation tunnel. The process may also generate a tunnel full of rock debris mixed in with the perforator charge debris. The extent of the damage, and the amount of loose debris in the tunnel, may be dictated by a variety of factors including formation properties, explosive charge properties, pressure conditions, fluid properties, and so forth. The shock damaged region and loose debris in the perforation tunnels may impair the productivity of production wells or the injectivity of injector wells.

One known method of achieving removal of debris from the perforation tunnels formed in the surrounding formation involves positioning a standard perforating gun or closed tube provided internally with a detonating cord and shaped charges of limited energy within a wellbore adjacent existing tunnels. Pressure within the wellbore is higher than the substantially lower atmospheric pressure inside the closed tube. With this arrangement, explosion of the charges inside the tube will cause openings to be formed in the tube only and not the casing such that a dynamic underbalance pressure condition or pressure differential is created between the wellbore and the inside of the tube. The underbalanced pressure condition results in a suction force that will draw debris out of the perforation tunnels formed in the surrounding formation into the tube enabling the well to flow more effectively. After a surge of debris from the perforation tunnels, the filled tube is removed from the wellbore and disposed of.

SUMMARY

The present inventors have found that use of the standard perforating gun described above has a number of inefficiencies which limit the dynamic underbalance effect. For example, the shaped charges positioned inside the known gun unnecessarily take up the volume thereof which needs to be maximized for the optimum debris removal from the perforation tunnels. In addition, detonation of the charges inside the gun causes swelling of the gun outer diameter such that the gun must be designed with an outer diameter which will allow removal from the wellbore after the internal explosion. Also, detonation of the shaped charges produces high pressure and heat inside the gun which must be overcome in order for the dynamic underbalance to be attained. Furthermore, such guns typically require special machining and contain many small parts adding to cost and creating exploded debris undesirably filling the inside of the gun.

The present application discloses a downhole tool and method of use which overcomes advantages and drawbacks found in the prior art. In one example, a downhole tool for use in a wellbore includes an elongated tubular body closed and sealed at opposite ends thereof and defining an internal chamber. The tubular body has an external surface formed with a recess extending inwardly and longitudinally of the tubular body. A detonating device is positioned adjacent the external surface of the tubular body and is located within the recess. The tubular body is adapted to be positioned in the wellbore in communication with perforation tunnels formed in a surrounding well formation. Additionally, the tubular body is designed to rupture inwardly into openings at areas of weakness provided locations along the external surface forming the recess upon firing of the explosive device.

In another example, a downhole tool for use in a wellbore includes an elongated tubular body closed and sealed at opposite ends thereof and defining an internal chamber. The tubular body has an external surface formed with selected areas of weakness along a length thereof. A detonating device is positioned adjacent the selected areas of weakness on the external surface of the tubular body.

In a further example, a downhole tool for use in a wellbore includes an elongated tubular body closed and sealed at opposite ends thereof and defining an internal chamber. The tubular body has an external surface formed with treated areas of weakness and an elongated recess extending longitudinally of the tubular body and running through the treated areas. A detonating device is retained in the recess and runs through the treated areas adjacent the external surface of the tubular body.

The present disclosure also contemplates an exemplary method for use in a wellbore comprising the steps of 1) providing an elongated closed tubular body defining an internal chamber, the tubular body having an external surface formed with treated areas and an elongated recess extending longitudinally of the tubular body and running through the treated areas; 2) retaining a detonating device in the recess adjacent the external surface of the tubular body; 3) positioning the tubular body with the detonating device in a wellbore adjacent perforation tunnels previously formed in a surrounding well formation and filled with debris; and 4) activating the detonating device to rupture the tubular body inwardly along the external surface forming the recess at the treated areas to expose the chamber within the tubular body to a dynamic underbalance pressure condition such that fluid from the wellbore and debris from the perforation tunnels is drawn through the wellbore and into the chamber.

The present disclosure further contemplates an exemplary method of making a downhole tool for use in a well wherein the method includes the steps of 1) supplying an elongated blank metal sheet having spaced apart side edges, an upper surface, a lower surface and a generally constant thickness; 2) forming stress raisers in the areas of the upper surface in the metal sheet along a length thereof; 3) forming an elongated recess in the upper surface of the metal sheet running through the areas of the stress raisers; 4) rolling the metal sheet and welding the side edges together to form a tubular body with the upper surface defining an external surface; 5) treating the tubular body to form a brittle structure in the areas of the stress raisers; 6) providing end cap structure on the tubular body; and 7) retaining a detonating device in the elongated recess formed in the external surface of the tubular body.

BRIEF DESCRIPTION OF THE DRAWINGS

The best mode of carrying out the invention is described herein below with reference to the following drawing figures.

DETAILED DESCRIPTION

In the following description, certain terms have been used for brevity, clearness and understanding. No unnecessary limitations are to be implied therefrom beyond the requirement of prior art because such terms are used for descriptive purposes and are intended to be broadly construed. The different configurations and methods described herein may be used alone or in combination with other configurations, systems and methods. It is to be expected that various equivalents, alternatives and modifications are possible within the scope of the appended claims.

Figure 1:
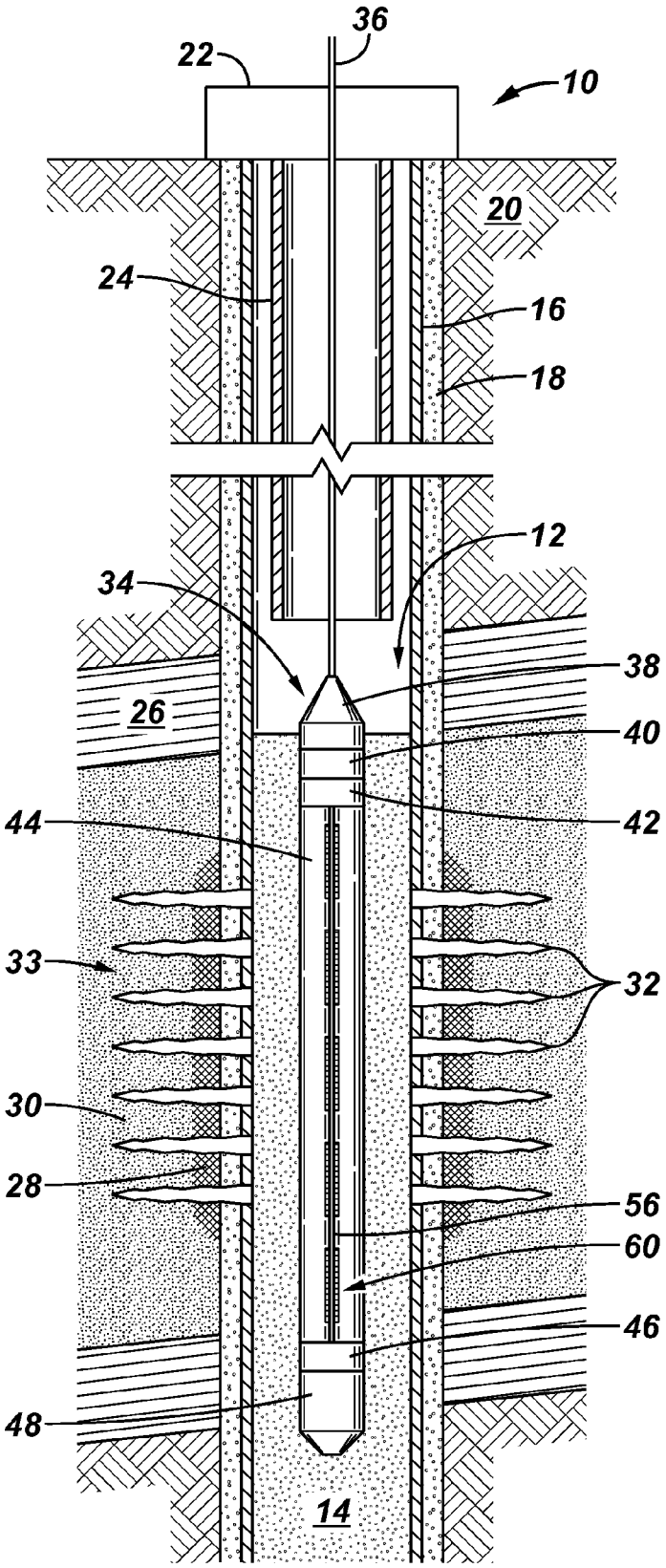
FIG. 1 is a sectional view of a well formation having a wellbore provided with a downhole tool according to the present disclosure.

Referring now to the drawings, FIG. 1 illustrates a typical well installation 10 including a wellbore 12 normally containing bore hole fluid 14. As is well known, the wellbore 12 has a surrounding casing 16 and cement 18 disposed between the casing 16 and the surrounding surface formation 20. A wellhead 22 is positioned at the top of the surface formation 20, and is provided with an open bottom tubing 24 that extends downwardly into an upper portion of the wellbore 12. In the well installation 10 illustrated, the surface formation 20 includes an area of caprock 26, a damaged formation 28 and an undamaged formation 30, all of which surround cement 18. Perforation tunnels 32 extend through the casing 16 and cement 18 into the damaged formation 28 at one or more desired formation zones 33. The perforation tunnels 32 are previously formed using a perforating gun string to allow fluid flow from the formation zones 33 to flow into the well for production to the surface, or to allow stimulating injection fluids to be applied to the formation zones. The explosive nature of the formation of the perforation tunnels 32 shatters sand grains in the damaged formation 28, and typically generates tunnels 32 full of rock debris mixed in with perforator charge debris. Such debris is known to impair the productivity of production wells and negatively impact upon the flow of formation fluids in the well. The present disclosure sets forth an apparatus and method used to clean the debris from the plugged perforation tunnels 32 by creating an increased dynamic underbalance pressure condition so as to improve fluid communication in the well.

In accordance with the present disclosure, a downhole tool assembly 34 is lowered into the wellbore 12 in a zone of previously formed perforation tunnels 32. The tool assembly 34 is suspended in the wellbore 12 by a carrier structure as by cable 36 that extends through the wellhead 22. A lower end of cable 36 is secured to a head 38 which, in turn, is connected to a casing collar locator 40 and a firing head 42. A downhole tool 44 in the form of an elongated hollow gun or tube has an upper end that is sealed and connected to the firing head 42, and a lower end sealed by an end cap 46 with a threaded end plug 47 attached to a high speed gauge carrier 48.

Figure 2:
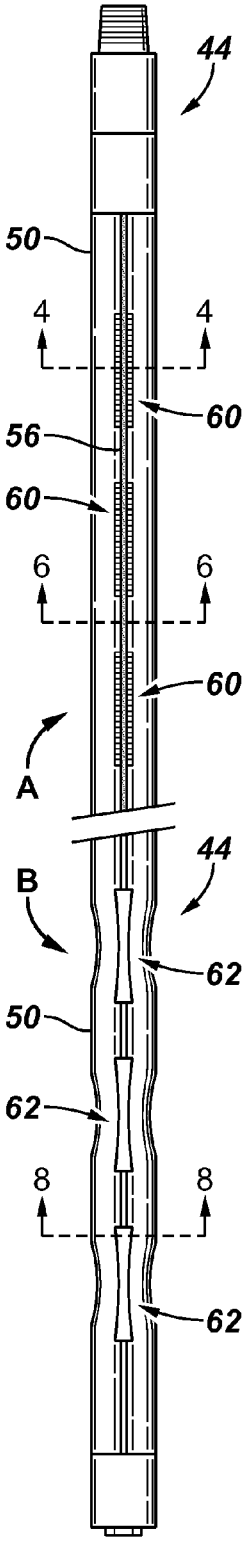
FIG. 2 is a representation of the downhole tool in fired and unfired conditions.

FIG. 2 shows the tool 44 removed from the wellbore 12 and includes an upper portion designated A illustrating the tool 44 in an installed or unfired condition. A lower portion of FIG. 2 designated B illustrates the tool 44 in a used or fired condition.

Figure 3:
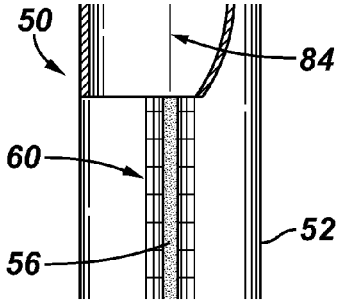
FIG. 3 is an enlarged fragmentary view of the downhole tool of FIG. 2 provided with stress raisers in an unfired condition.
Figure 4:
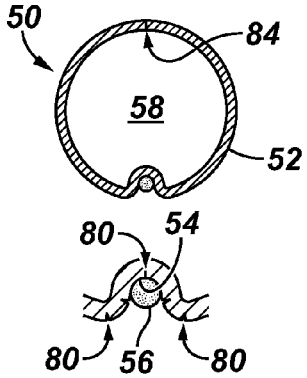
FIG. 4 is a sectional view taken on line 4-4 of FIG. 2.

Referring now to the upper portion A of FIG. 2 as well as FIGS. 3 and 4, the downhole tool 44 has an elongated tubular body 50 which is generally cylindrical in cross section, and is constructed of a suitable outer diameter that will permit insertion and extraction thereof relative to the wellbore 12. The tubular body 50 has an external surface 52 formed with an inwardly extending, generally concave recess 54 extending substantially parallel to a longitudinal axis of the tubular body along an entire length thereof. The recess 54 is shaped to frictionally receive and retain an elongated explosive or detonating device, such as a primer or detonating cord 56, which is coextensive with the length of the recess 54. While not illustrated, the recess 54 and primer or detonating cord 56 may alternatively be formed along a spiral path extending along the entire length of the tubular body 50. An upper end of the detonating cord 56 is connected for selective activation or firing with the firing head 38. Tubular body 50, when positioned in the downhole tool assembly 34, defines a sealed internal underbalanced chamber 58 which is designed to be completely empty before firing of the detonating cord 56. The chamber 50 typically contains only air at atmospheric pressure such as that set at the surface before insertion into the wellbore 12. Air at atmospheric pressure provides an initial chamber pressure which is significantly less than the wellbore pressure encountered at a formation zone 33.

As seen in the upper portion A of FIG. 2 and in FIG. 3, certain selected areas of the external surface 52 forming the recess 54 are formed with stress raisers 60 at spaced apart locations along the length of the tubular body 50. The stress raisers 60 create areas of high stress which are treated at various temperatures to create brittle structures in selected areas of weakness that are designed to fail or rupture upon firing of the primer or detonating cord 56.

Figure 5:
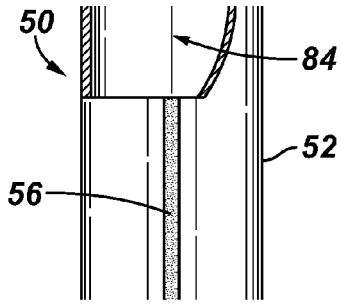
FIG. 5 is an enlarged fragmentary view of the downhole tool of FIG. 2 provided without stress raisers in an unfired condition.
Figure 6:
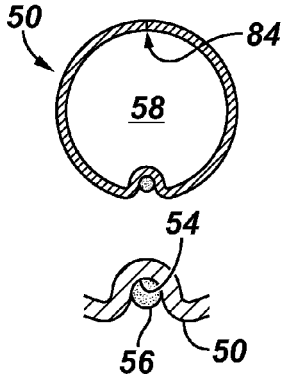
FIG. 6 is a sectional view taken on line 6-6 of FIG. 2.

As shown in FIGS. 5 and 6, other selected areas of the external surface 52 forming the recess 54 are formed without the stress raisers 60 and any brittle structure treatment at locations along the length of the tubular body 50 generally above and below the areas defining the stress raisers 60. These other selected areas of the external surface 52 forming the recess 54 are designed not to fail upon firing of the detonating cord 56. It should be appreciated that the detonating cord 56 is frictionally retained in the recess 54 along the length thereof, and runs continuously along the length of the tubular body 50 through locations designed to provide alternating spaced apart areas of rupture in the external surface 52 forming the recess 54 upon activation or firing of the primer or detonating cord 56.

The operation of the downhole tool assembly 34 of the present disclosure will now be described with initial reference to FIG. 1 which shows the downhole tool 34 suspended in the wellbore 12 and positioned adjacent a formation zone 33 having a series of previously formed perforation tunnels 32 filled with damaged debris. The tool 44 is in the installed or unfired condition as described above with the internal chamber 50 of the tool 44 being at atmospheric pressure which is significantly lower than the pressures in the surrounding wellbore 12 and surrounding formation 20.

Figure 7:
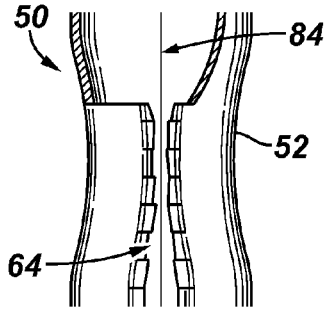
FIG. 7 is an enlarged fragmentary view of the downhole tool of FIG. 2 provided with stress raisers immediately following a fired condition.
Figure 8:
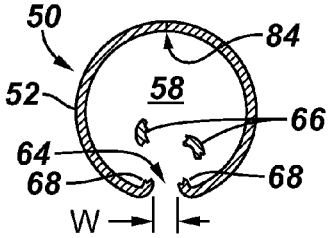
FIG. 8 is sectional view taken on line 6-6 of FIG. 2.
Figure 9:
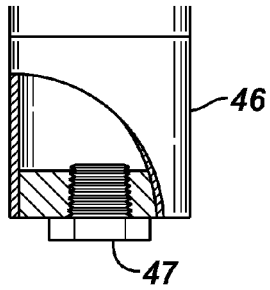
FIG. 9 is a view of an end cap provided on the downhole tool.

When it is desired to operate the downhole tool assembly 34, a well operator actuates the firing head 42 and detonates the detonating cord 56 causing an extremely rapid explosion along the length of the tubular body 50. The firing of primer or detonating cord 56 creates an implosive force in the selected locations of the external surface 52 forming the recess 54 and provided with the brittle areas defined by the treated stress raisers 60. This implosive force results in a series of spaced apart, failed sections 62 along the length of the tubular body 50 as depicted in the lower portion B of FIG. 2. Each failed section 62 has a fractured elongated opening 64 as shown in FIGS. 7 and 8. The latter figure depicts the implosive fragmentation of tubular body pieces 66 as each opening is 64 formed with a variable width w lying between the remaining inwardly directed edges 68 of the fractured tubular body 50. In FIG. 8, it should be appreciated that, in reality, the trajectory of the imploded pieces 66 is directed within the chamber 58 where the pieces 66 are collected on the bottom thereof.

Immediately upon the formation of the spaced apart fractured opening 64 formed along the tubular body, a pressure differential between the higher pressure in the wellbore 12 and the atmospheric pressure in the chamber 50 creates a dynamic underbalanced pressure condition. This results in a suction flow of fluid from the wellbore 12 and debris from the perforation tunnels 32 through the wellbore 12 and into the chamber 50 where the fluid and the debris are deposited. Accordingly, the perforation tunnels 32 are effectively cleaned of debris to enable better fluid communication within the well. The cleansing inflow continues for a short period until a stasis or equilibrium is reached between the pressures in the wellbore 12 and the chamber 50. Hence, use of the downhole tool 44 ensures clean perforation tunnels 32 by providing a dynamic underbalance condition. Once the cleansing inflow has ceased, the tool 44 filled with fluid and debris is extracted from the wellbore 12 such that the cleaned material deposited in the tube 50 may be analyzed, if desired. Thereafter, the fractured tool 44 may be disposed of.

It should be understood that during the actual use of the downhole tool 44, the sections of the tubular body 50 designed not to fail, as shown in FIGS. 5 and 6, maintain the integrity of the tool 50.

In addition, it can be seen from FIG. 7 that upon implosion, the external surface 52 of the tubular body 50 in the sections designed to fail undergoes a slight inward deformation which will not hinder the removal of tool 44 from wellbore 12.

The present inventors have found that in the prior art, use of explosive devices inside guns or tubes having low pressure chambers has reduced effectiveness of the dynamic underbalanced pressure condition in cleaning perforation tunnels. This reduced effectiveness is due to the volume reduction inside the chamber caused by the placement of the explosive device, and the production of high pressure gas inside the tube upon actuation of the explosive device which must be overcome to attain the dynamic underbalance condition.

The downhole tool 44 of the present disclosure strategically positions and conveniently retains the primer or detonating cord 56 in the recess 54 formed by the external surface 52 to maximize the volume available inside the chamber 58 and eliminate high pressure therein so as to increase the dynamic underbalance effect over that previously attained. In addition, the present disclosure contemplates directly engaging the primer or detonating cord 56 with selected treated areas of the external surface 52 forming the recess 54 that are specifically designed to fail upon firing of the cord 56. This arrangement results in providing an implosive force to create fractured elongated openings 64 that promote increased dynamic underbalanced conditions over those attained by the prior art devices formed with explodable circular areas.

Figure 10:
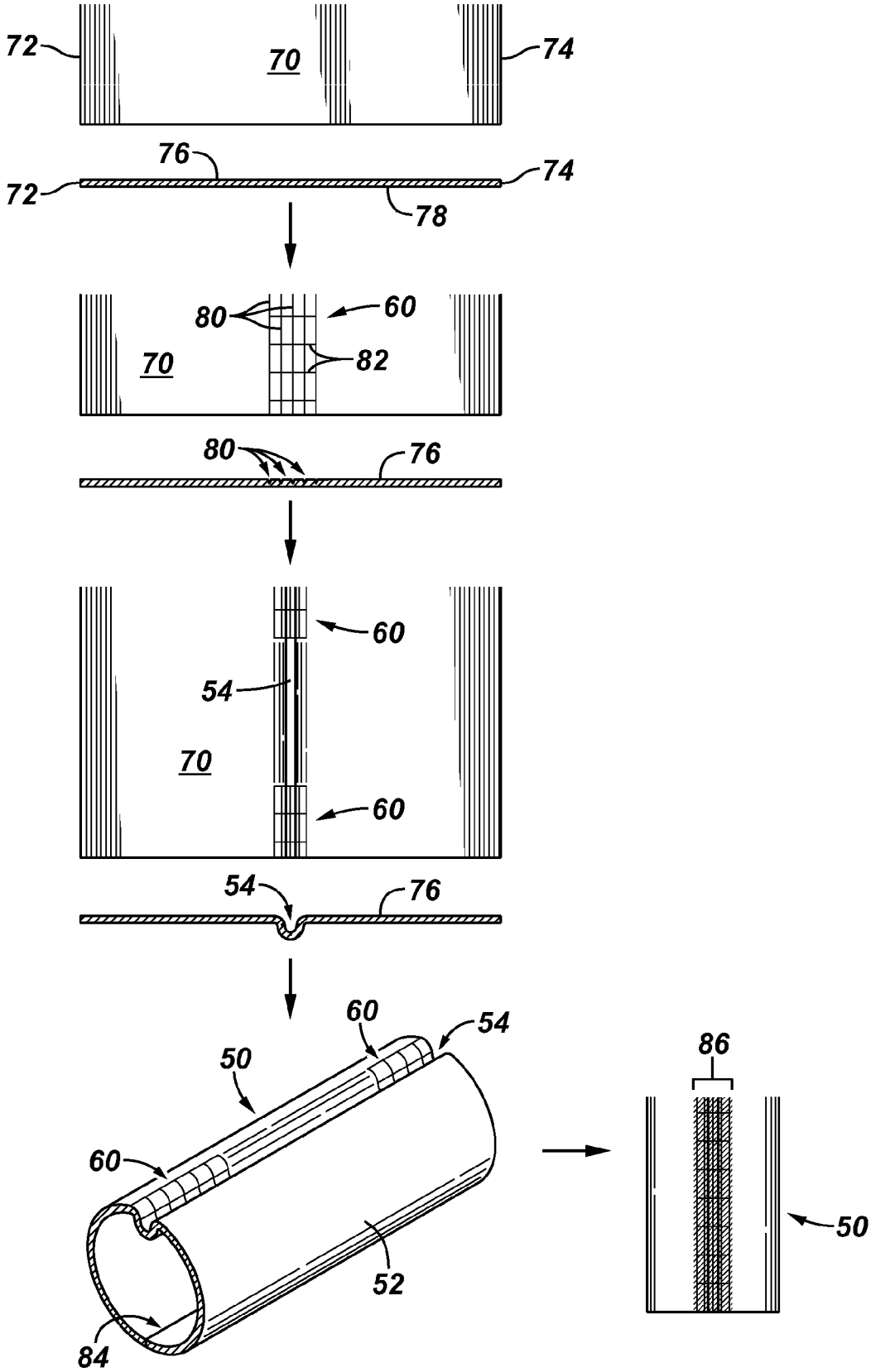
FIG. 10 is a pictorial representation depicting one example of the making of the downhole tool.
Figure 11:
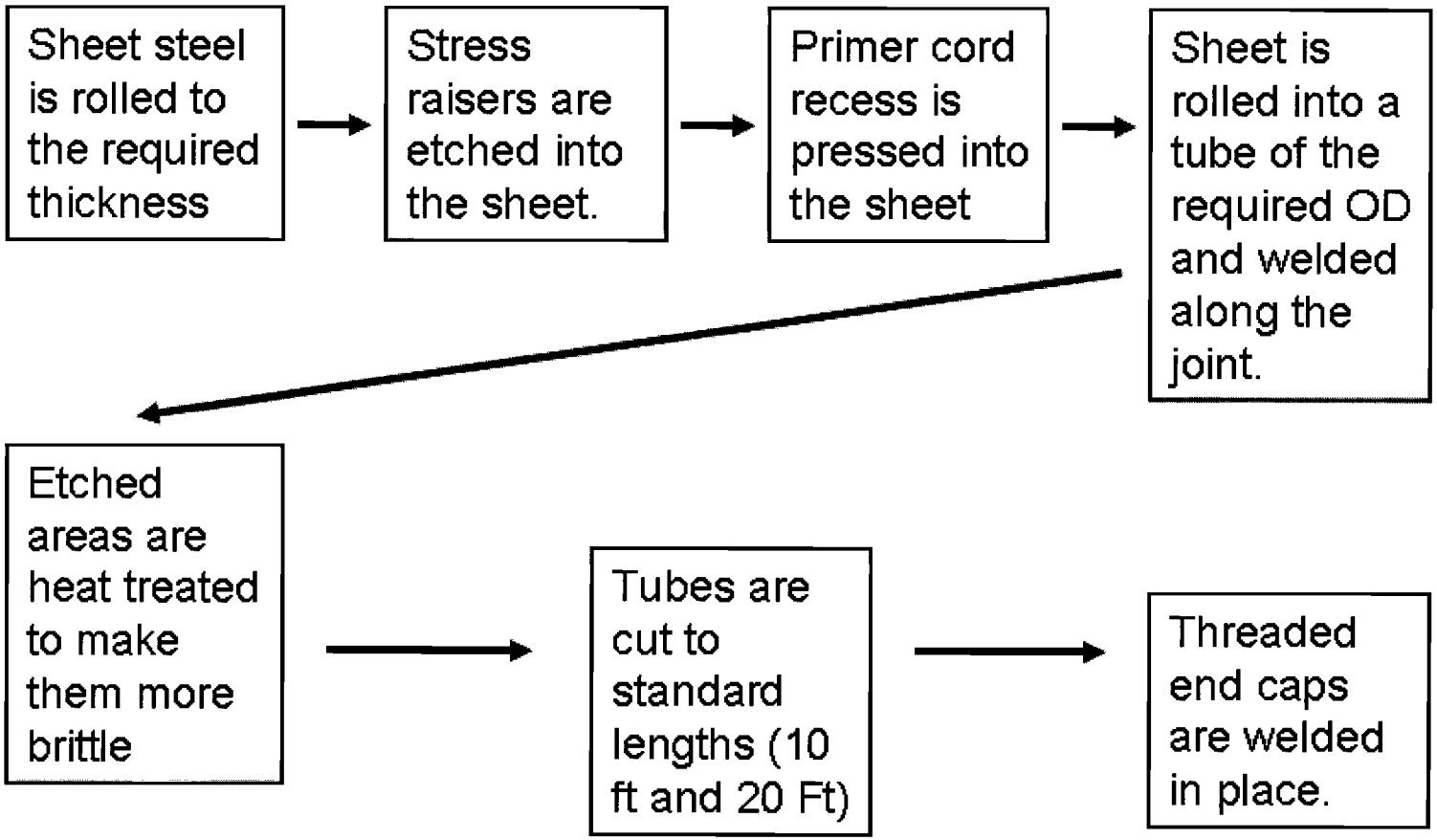
FIG. 11 is a flow charge further describing the exemplary making of the downhole tool.

FIGS. 10 and 11 set forth an exemplary method of making the downhole tool 44. First, sheet steel 70 is rolled to a desired, substantially constant thickness so that it has opposed side edges 72, 74, an upper surface 76 and a lower surface 78. Next, selected spaced apart areas of the sheet 70 are etched or grooved with the stress raisers 60 including longitudinally extending stress raisers 80 and transversely extending stress raisers 82. Following the etching, the elongated primer cord recess 54 is pressed into the sheet 70 so that the recess 54 runs continuously along the sheet 70 through the selected spaced apart areas formed with the stress raisers 60.

Upon formation of recess 54, sheet 70 is rolled into tubular body 50 such that opposite edges 72, 74 are joined together in a weld joint 84. Once tubular body 50 is formed, the upper surface 76 of sheet 70 becomes the external surface 52 previously discussed above. Then, the selected etched areas of stress raisers 60 are heat treated and quenched to make these areas more brittle in structure as represented by numeral 86. The elongated tubular body 50 may then be cut, if desired, into typical lengths of 10 feet and 20 feet. Finally, end caps 46 with threaded end plugs 47 are welded into place on open ends of the individually formed tubular bodies 50, each of which are positioned for use as a closed container between the firing head 42 and the carrier 48 when constructing the tool assembly 34.

What is claimed is:

1. A downhole tool for use in a wellbore comprising:

an elongated tubular body closed and sealed at opposite ends thereof and defining an internal chamber, the tubular body having an external surface formed with a recess extending inwardly and longitudinally of the tubular body; and a detonating device positioned adjacent the external surface of the tubular body and located within the recess, wherein the tubular body is constructed with selected areas of high stress along the external surface forming the recess that are temperature treated and designed to rupture upon firing of the detonating device.

2. The downhole tool of claim 1, wherein the recess extends substantially parallel to a longitudinal axis of the tubular body.

3. The downhole tool of claim 1, wherein the recess extends along substantially an entire length of the tubular body.

4. The downhole tool of claim 1, wherein the detonating device is frictionally retained in the recess along an entire length of the tubular body.

5. The downhole tool of claim 1, wherein the detonating device is a detonating cord.

6. The downhole tool of claim 1, wherein the tubular body is adapted to be positioned in the wellbore in communication with perforation tunnels formed in a surrounding well formation.

7. A downhole tool for use in a wellbore comprising:

an elongated tubular body closed and sealed at opposite ends thereof and defining an internal chamber, the tubular body having an external surface formed with a recess extending inwardly and longitudinally of the tubular body; and a detonating device positioned adjacent the external surface of the tubular body and located within the recess, wherein the tubular body is constructed of a metal material having brittle areas formed along the external surface containing the recess.

8. The downhole tool of claim 7, wherein the brittle areas include a series of stress raisers.

9. A downhole tool for use in a wellbore comprising:

an elongated tubular body closed and sealed at opposite ends thereof and defining an internal chamber, the tubular body having an external surface formed with a recess extending inwardly and longitudinally of the tubular body; and a detonating device position adjacent the external surface of the tubular body and located within the recess, wherein the tubular body is designed to rupture inwardly into openings at selected areas of weakness provided along the external surface forming the recess upon firing of the detonating device.

10. A downhole tool for use in a wellbore comprising:

an elongated tubular body closed and sealed at opposite ends thereof and defining an internal chamber, the tubular body having an external surface formed with a recess extending inwardly and longitudinally of the tubular body; and a detonating device positioned adjacent the external surface of the tubular body and located within the recess, wherein the detonating device is directly engaged in the recess with certain sections of the tubular body designed to fail and other sections of the tubular body designed not to fail upon firing of the detonating device.

11. A downhole tool for use in a wellbore comprising:

an elongated tubular body closed and sealed at opposite ends thereof and defining an internal chamber, the tubular body having an external surface formed with selected areas of weakness along a length thereof; and a detonating device positioned adjacent the selected areas of weakness on the external surface of the tubular body.

12. A downhole tool for use in a wellbore comprising:

an elongated tubular body closed and sealed at opposite ends thereof and defining an internal chamber, the tubular body having an external surface formed with treated areas of weakness and an elongated recess extending longitudinally of the tubular body and running through the treated areas; and a detonating device retained in the recess running through the treated areas adjacent the external surface of the tubular body.

13. A method for use in a wellbore, the method comprising the steps of:

providing an elongated closed tubular body defining an internal chamber, the tubular body having an external surface formed with treated areas and an elongated recess extending longitudinally of the tubular body and running through the treated areas;

retaining a detonating device in the recess adjacent the external surface of the tubular body;

positioning the tubular body with the detonating device in a wellbore adjacent perforation tunnels previously formed in a surrounding well formation and filled with debris; and activating the detonating device to rupture the tubular body inwardly along the external surface forming the recess at the treated areas to expose the chamber within the tubular body to a dynamic underbalance pressure condition such that fluid from the wellbore and debris from the perforation tunnels are drawn through the wellbore and into the chamber.

14. The method of claim 13, wherein pressures in the wellbore and the surrounding formation are greater than an atmospheric pressure inside the chamber.

15. The method of claim 13, wherein activating the detonating device comprises activating a detonating cord.

16. The method of claim 13, wherein the treated areas include stress raisers that are treated to form a brittle structure.

17. The method of claim 13, wherein the internal chamber is completely empty and filled with air at atmospheric pressure before actuating the detonating device.

18. The method of claim 13, wherein the tubular body includes an end cap defining a bottom surface for supporting the fluid and debris drawn into the chamber following the activating of the detonating device.

19. A method of making a downhole tool for use in a well, the method comprising the steps of:

supplying an elongated blank metal sheet having spaced apart side edges, an upper surface, a lower surface and a generally constant thickness;

forming stress raisers in areas of the upper surface of the metal sheet along a length thereof;

forming an elongated recess in the upper surface of the metal sheet running through the areas of the stress raisers;

rolling the metal sheet and welding the side edges together to form a tubular body with the upper surface defining an external surface;

treating the tubular body to form a brittle structure in the areas of the stress raisers;

providing end cap structure on the tubular body; and retaining a detonating device in the elongated recess formed in the external surface of the tubular body.

20. The method of claim 19, wherein the step of supplying a blank metal sheet includes the step of rolling steel into a sheet of substantially constant thickness.

21. The method of claim 19, wherein the elongated recess has a generally concave configuration configured to frictionally retain the detonating device therein.

22. The method of claim 19, wherein following the step of rolling the metal sheet and welding the side edges together to form a tubular body, the tubular body is cut to desired lengths.

23. A method for use in a wellbore, the method comprising the steps of:

providing an elongated closed tubular body defining an internal chamber, the tubular body having an external surface formed with an elongated recess extending longitudinally of the tubular body;

retaining a detonating device in the recess adjacent the external surface of the tubular body;

positioning the tubular body with the detonating device in a wellbore containing fluid adjacent perforation tunnels previously formed in a surrounding well formation and filled with debris; and activating the detonating device to rupture the tubular body inwardly along the external surface forming the recess to expose the chamber within the tubular body to a dynamic underbalance pressure condition such that fluid from the wellbore and debris from the perforation tunnels are drawn through the wellbore and filled into the chamber to clean the perforation tunnels.

24. The method of claim 23, including the step of extracting the tubular body filled with fluid and debris from the wellbore.

* * * * *